US008448408B2

(12) United States Patent
Kalwara

(10) Patent No.: US 8,448,408 B2
(45) Date of Patent: May 28, 2013

(54) METHOD OF ADHERING EPDM MEMBRANES TO NON-POROUS SUBSTRATES

(75) Inventor: Joseph John Kalwara, Indianapolis, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 546 days.

(21) Appl. No.: 12/704,574

(22) Filed: Feb. 12, 2010

(65) Prior Publication Data

US 2010/0205896 A1 Aug. 19, 2010

Related U.S. Application Data

(60) Provisional application No. 61/152,841, filed on Feb. 16, 2009.

(51) Int. Cl.
*E04B 1/00* (2006.01)

(52) U.S. Cl.
USPC ..... 52/746.11; 52/741.4; 52/411

(58) Field of Classification Search
USPC ..... 52/741.4, 745.21, 746.1, 746.11, 52/408, 409, 411
See application file for complete search history.

(56) References Cited

U.S. PATENT DOCUMENTS

| | | | | |
|---|---|---|---|---|
| 4,521,479 | A * | 6/1985 | Maglio et al. | 428/326 |
| 6,586,080 | B1 * | 7/2003 | Heifetz | 428/198 |
| 2008/0029210 | A1 * | 2/2008 | Swei et al. | 156/272.2 |
| 2010/0162657 | A1 * | 7/2010 | Swei et al. | 52/745.06 |

* cited by examiner

*Primary Examiner* — William Gilbert
(74) *Attorney, Agent, or Firm* — Jason A. Houser; Arthur M. Reginelli

(57) ABSTRACT

A method of adhering a roofing membrane to a roof surface including providing a roofing membrane including a hygroscopic dusting agent on at least one planar surface of the membrane. A water-borne adhesive is applied to the at least one planar surface of the membrane or the roof surface and the roofing membrane is then mated to the roof surface while the adhesive retains a majority of its original water content.

21 Claims, 1 Drawing Sheet

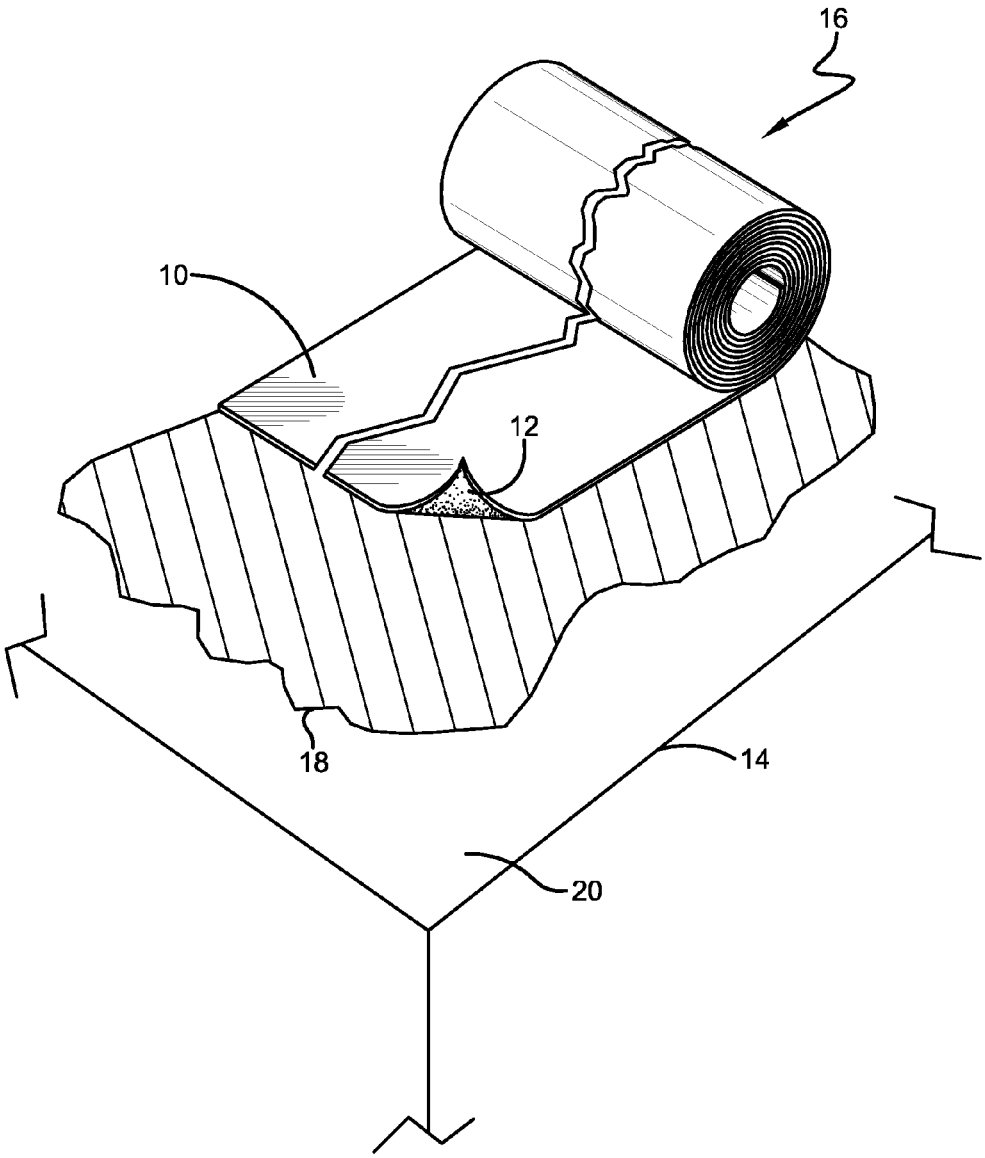
16
10
12
18
14
20

METHOD OF ADHERING EPDM MEMBRANES TO NON-POROUS SUBSTRATES

This application claims the benefit of U.S. Provisional Patent Application Ser. No. 61/152,841, filed on Feb. 16, 2009, which is incorporated herein by reference.

FIELD OF THE INVENTION

One or more embodiments of this invention relate to a method of adhering roofing membranes to non-porous substrates. Particular embodiments relate to wet lamination adhesion of EPDM membranes to non-porous substrates in the presence of a hygroscopic dusting agent.

BACKGROUND OF THE INVENTION

EPDM membranes, which are cured sheets of ethylene-propylene-diene copolymer rubber, are often used in the construction industry to cover flat or low-sloped roofs. During manufacture of the EPDM membranes, uncured sheets, also referred to as green membranes, are rolled and placed into a curing oven to effect vulcanization of the rubber in the presence of a cure system. In order to prevent the roll of green membrane from sticking to itself ("blocking"), and ultimately curing to itself, the membrane is treated with a dusting agent prior to being rolled and cured. Industry standards include the use of talc and mica for dusting, although other materials have been used such as, for example, cellulosic materials.

These membranes, which may also be referred to as panels, are typically delivered to a construction site in a bundled roll, transferred to the roof, and then unrolled and positioned. The sheets are then affixed to the building structure by employing varying techniques such as mechanical fastening, ballasting, and/or adhesively adhering the membrane to the roof. The roof substrate to which the membrane is secured may be one of a variety of materials depending on the installation site and structural concerns. For example, the surface may be a concrete, metal, or wood deck, it may include insulation or recover board, and/or it may include an existing membrane.

In addition to securing the membrane to the roof—which mode of attachment primarily seeks to prevent wind uplift—the individual membrane panels, together with flashing and other accessories, are positioned and adjoined to achieve a waterproof barrier on the roof. Typically, the edges of adjoining panels are overlapped, and these overlapping portions are adjoined to one another through a number of methods depending upon the membrane materials and exterior conditions. One approach involves providing adhesives or adhesive tapes between the overlapping portions, thereby creating a water resistant seal.

Thus, there are two modes of membrane attachment that are used in conjunction to create a water impermeable roofing membrane assembly. The first seeks to anchor the membrane to the roof, while the second seeks to create a water impervious barrier by attaching individual adjacent membrane panels to each other or to flashing. Inasmuch as these modes of membrane attachment seek entirely different goals, the mechanisms by which they operate are likewise highly distinct.

With respect to the former mode of attachment, which involves securing of the membrane to the roof, the use of adhesives allow for the formation of a fully-adhered roofing system. In other words, a majority, if not all, of the membrane panel is secured to the roof substrate, as opposed to mechanical attachment methods which can only achieve direct attachment in those locations where a mechanical fastener actually affixes the membrane.

When adhesively securing a membrane to a roof, such as in the formation of a fully-adhered system, there are two common methods employed. The first is known as contact bonding whereby technicians coat both the membrane and the substrate with an adhesive, and then mate the membrane to the substrate while the adhesive is only partially set. Because the volatile components (e.g. solvent) of the adhesives are flashed off prior to mating, good early (green) bond strength is developed. The contact bonding method employs adhesives that may include volatile organic compounds (i.e. solvent-based adhesives). Water-based adhesives are used for contact bonding as well, but the water does not flash off quickly and therefore the use of water-based adhesives for contact bonding may be fraught with problems.

The other method of adhesively securing a membrane to a roof is known as wet lamination, whereby technicians coat the substrate with an adhesive and then mate the membrane with the substrate while the adhesive is still wet. This method can therefore advantageously employ water-based adhesives due to the fact that the mating step can occur immediately after application of the solvent, which significantly reduces installation time. But, wet lamination can only be used when the substrate to which the membrane is being adhered is porous (e.g. wood, plywood, or OSB board), which allows the water to dissipate through the substrate. The use of this technique to secure a membrane to a non-porous substrate, such as an existing membrane, is not a viable option because water from the water-based adhesive is trapped between the non-porous substrate and the membrane (which is also non-porous).

Nonetheless, wet lamination is a preferred method for a variety of reasons, including that the water-borne adhesive need only be applied to one surface, the method does not require drying time, the method is less sensitive to heat and sun conditions during application, less labor intensive, uses less material, and it uses environmentally-friendly water-borne adhesives.

Therefore, there is a need for an improved method of adhering roofing membranes to a roof substrate that facilitates adhesion to non-porous surfaces using the wet lamination technique.

SUMMARY OF THE INVENTION

Certain embodiments of this invention provide a method of adhering a roofing membrane to a roof surface, the method comprising the steps of: providing a roofing membrane including a hygroscopic dusting agent on at least one planar surface of the membrane; applying a water-borne adhesive to at least one of the at least one planar surface of the membrane and the roof surface; and mating the roofing membrane to the roof surface.

Certain embodiments of this invention also provide a method of adhering a roofing membrane to a non-porous substrate on a roof surface or non-porous roofing material, the method comprising the step of: providing a roofing membrane including a hygroscopic dusting agent on at least one planar surface of the membrane; applying a water-borne adhesive to at least one of the at least one planar surface of the membrane and the non-porous substrate; and mating the roofing membrane to the roof surface.

Certain embodiments of this invention include method of providing a roofing contractor with a system for fully adhering a roofing membrane to a non-porous substrate on a roofing surface, the method comprising: providing a roofing membrane including a hygroscopic dusting agent on at least one planar surface of the roofing membrane in combination with a water-borne adhesive for fully-adhering the roofing membrane to the roof surface, where at least a portion of the roof surface includes a non-porous substrate to which the membrane can be secured via the water-borne adhesive.

BRIEF DESCRIPTION OF THE DRAWINGS

This and other features and advantages of the present invention will become better understood with regard to the following description, appended claims, and accompanying drawings wherein:

FIG. 1 is a perspective view of a fully-adhered roofing system according to the concepts of the present invention.

DETAILED DESCRIPTION OF ILLUSTRATIVE EMBODIMENTS

Certain embodiments of the present invention are directed to methods of securing roofing membranes to a substrate using a water-borne adhesive in the presence of a hygroscopic particulate. The presence of the hygroscopic particulate advantageously allows a water-borne adhesive to be used even when the substrate is a non-porous substrate and thereby allows the membrane to be adhered to non-porous substrates by wet lamination techniques. In one or more embodiments, the hygroscopic particulate may be provided in the form of a dusting agent on an EPDM membrane panel, thereby serving the additional function of preventing the successive layers of a roll of EPDM membrane from sticking together during vulcanization. In particular embodiments of the present invention the method includes re-skinning of flat or low-sloped roofs whereby a roofing membrane is fully adhered to an existing roofing membrane by using water-borne adhesives in the presence of a hygroscopic particulate.

Practice of the present invention is not necessarily limited by the selection of a particular roofing membrane that is secured to a substrate on a roof surface. As is known in the art, numerous roofing membranes have been proposed in the art and several are used commercially including thermoset and thermoplastic roofing membranes. Commercially available thermoplastic roofing membranes may include polyvinyl chloride, or polyolefin copolymers. For example, thermoplastic olefin (TPO) membranes are available under the tradenames UltraPly™, and ReflexEON™ (Firestone Building Products). Commercially available thermoset roofing membranes may include elastomeric copolymers such as ethylene-propylene-diene copolymer (EPDM) rubber and functionalized olefins such as chlorosulfonated polyethylene (CSPE). For example, EPDM membranes are available under the tradename RubberGard™, RubberGard Platinum™, RubberGard EcoWhite™, and RubberGard MAX™ (Firestone Building Products).

In particular embodiments, EPDM membranes are employed. As is known in the art, EPDM membrane panels include vulcanized or cured rubber compositions. These compositions may include, in addition to the rubber that is ultimately vulcanized, fillers, processing oils, and other desired ingredients such as plasticizers, antidegredants, adhesive-enhancing promoters, etc., as well as vulcanizing agents such as sulfur or sulfur-donating compounds.

In one or more embodiments, the EPDM roofing panels have a thickness in accordance with ASTM D-4637-04. In one or more embodiments, the EPDM roofing panels have a thickness of at least 45 mil±10%, in other embodiments at least 60 mil±10%, and in other embodiments at least 90 mil±10%. In these or other embodiments, the EPDM roofing panels may have a thickness of less than 65 mil±10%, in other embodiments less than 80 mil±10%, and in other embodiments less than 110 mil±10%.

In one or more embodiments, the roofing membranes (e.g. EPDM roofing panels) employed in the practice of the present invention include a hygroscopic dusting agent on at least one of their planar surfaces. In other words, these dusting agents are secured (but can be removed) to the surface through one or more physical or chemical modes of attachment. Those skilled in the art will appreciate that while secured or attached to the surface of the membrane, this securing or attaching can be accomplished without the need for any attachment mechanisms or means such as an adhesive matrix; those skilled in the art understand that the act of applying hygroscopic dusting agents, which are in the form of small particles, will allow the particles to sufficiently secure themselves to the surface of the membrane panel.

In one or more embodiments, especially where the roofing membrane includes a thermoset roofing membrane, the dusting agent is applied to at least one planar surface of the roofing membrane prior to heat-initiated curing or vulcanization of the membrane, which may occur in an autoclave or a curing oven. As is generally practiced in the art, the dusting agent may be applied to the uncured or green membrane panel, and then the membrane panel can be rolled for subsequent curing. In other embodiments, the hygroscopic dusting agent is applied to the roofing panel after curing or otherwise after complete fabrication of the roofing panel.

In one or more embodiments, hygroscopic dusting agents include substances that have the ability to absorb moisture from the surrounding environment. In one or more embodiments, hygroscopic dusting agents include desiccants, which are substances or materials that are capable of attaching to and holding water molecules. Examples of hygroscopic dusting agents include, for example, silica gel, calcium chloride, zinc chloride, particulate cellulose, and absorbent clay particulate.

In one or more embodiments, the hygroscopic dusting agents may have a particle size allowing them to pass through a number 220 mesh screen, in other embodiments a number 200 screen, and in other embodiments a number 80 screen.

Practice of the present invention is not necessarily limited by the selection of the water-borne adhesive that may be employed to secure or adhere the roofing membrane to the surface of a roof. In one or more embodiments, the water-borne adhesive includes a synthetic latex that may optionally include other additives used in the art to promote the adhesive properties of the latex. These latexes may include acrylic-based latexes, polychloroprene-based polymers, acrylate-based latexes, diene-based latexes, and natural rubber latexes. An example of a useful bonding adhesive is available under the tradename RubberGard™ Modular Water Based Bonding Adhesive WBA-3781 (Firestone Building Products).

In one or more embodiments, the water-borne bonding adhesive may have a solids content of at least 40% by weight, in other embodiments at least 45% by weight, and in other embodiments at least 50% by weight based on the entire weight of the adhesive composition. In these or other embodiments, the adhesive may have a solids content of less than 70% by weight, in other embodiments less than 65% by weight, and in other embodiments less than 60% by weight based on the entire weight of the adhesive composition.

In one or more embodiments, the water-borne bonding adhesive may have a volatile organic compound (V.O.C.) content of less than approximately 400 g/l, other embodiments less than approximately 350 g/l, in other embodiments less than approximately 300 g/l, and in still other embodiments less than approximately 250 g/l.

I. Method of Adhering Roofing Membrane

In one or more embodiments, as generally shown in FIG. 1, the membrane 10, which is dusted with the hygroscopic dusting agents 12, and which may be referred to as a hygroscopic dusting-agent coated roofing membrane, may be supplied to a roof 14 for installation as part of a new-construction membrane roofing system or as part of a reroof or re-skin roofing system both of which are designated by the numeral 16. In certain embodiments, the hygroscopic dusting agent coated roofing membrane is employed in the construction or installation of a fully-adhered roofing system. In particular embodiments, re-skinning of a flat or low-sloped roof includes application of membrane panels over an existing membrane, and in certain embodiments may include fully adhering the hygroscopic-dusting-agent-coated membrane to an existing membrane.

In one or more embodiments, the hygroscopic dusting agent coated roofing membrane is secured or adhered to a non-porous substrate on the roofing surface. As is known in the art, non-porous substrates include those substrates that are impervious or substantially impervious to water. Examples of non-porous substrates include existing roofing membranes and metal roofs. Examples of existing roofing membranes include, but are not limited to, EPDM membranes, TPO membranes, and PVC membranes.

In one or more embodiments, the method of adhering the hygroscopic-dusting-agent-coated roofing membrane includes first applying the water-borne bonding adhesive 18 to a substrate 20 to which the membrane will be attached. The water-borne adhesive may be applied by any method known to persons skilled in the art. In one or more embodiments, the water-borne adhesive may be applied by using a roller to coat the substrate. In other embodiments, the water-borne adhesive may be applied by a sprayer, a power roller, or a drop spreader followed by rolling. In other embodiments, the water-borne adhesive may be applied to the hygroscopic dusting-agent coated EPDM membrane. In yet other embodiments, the water-borne adhesive may be applied to the hygroscopic dusting agent coated EPDM membrane and to the substrate such as a non-porous substrate.

In one or more embodiments, the roofing membrane may be mated with the substrate while the surface that was treated with the adhesive is still substantially wet. The term "substantially wet", as used herein, means that the water-borne adhesive has not been allowed to substantially dry and therefore the adhesive composition still contains a substantial portion of its water content. In one or more embodiments, the term "substantially wet" should be interpreted as meaning that the waterborne adhesive retains a water content of at least approximately 90%, in other embodiments at least approximately 75%, and in other embodiments at least approximately 50%.

In one or more embodiments, pressure is applied to the roofing membrane after mating the membrane with the substrate. In one or more embodiments, the roofing membrane may be pressed against the substrate by use of, for example, a push broom or roller.

In one or more embodiments, the hygroscopic dusting agent provided on the EPDM membrane advantageously absorbs moisture (i.e. water) from the water-borne bonding adhesive and thereby allows the adhesive to cure even though the water may be prohibited from evaporating into the atmosphere or absorbing into the substrate.

Inasmuch as it has been unexpectedly discovered that the presence of a hygroscopic dusting agent allows contractors to construct fully-adhered roofing systems on non-porous substrates by using water-borne adhesives, the discoveries of the present invention thereby provide unique marketing opportunities for membrane manufacturers. For example, membrane manufacturers can sell roofing membranes in conjunction with water-borne adhesive for re-roofing situations whereby the membrane, which is coated with a hygroscopic dusting agent, can be fully adhered to an existing roofing membrane by using the water-borne adhesive.

Various modifications and alterations that do not depart from the scope and spirit of this invention will become apparent to those skilled in the art. This invention is not to be duly limited to the illustrative embodiments set forth herein.

What is claimed is:

1. A method of adhering a roofing membrane to a roof surface, the method comprising the steps of:

providing a roofing membrane including a hygroscopic dusting agent on at least one planar surface of the membrane;

applying a water-borne adhesive to at least one of the at least one planar surface of the membrane and a roof surface, wherein the roof surface is a non-porous roofing membrane; and mating the at least one planar surface with said hygroscopic dusting agent of said roofing membrane to the roof surface while the water-borne adhesive retains at least approximately 50 percent of its original water content and wherein the hygroscopic dusting agent absorbs the remaining water content to allow the adhesive to cure even though the water is prohibited from evaporating or being absorbed by either membrane.

2. The method of claim 1, wherein the step of applying a water-borne adhesive is performed using one of a roller, a sprayer and a power roller.

3. The method of claim 1, wherein the step of applying a water-borne adhesive includes applying the water-borne adhesive to both the at least one planar surface of the membrane and the roof surface.

4. The method of claim 1, further comprising the step of applying pressure to the roofing membrane after it has been mated to the roof surface.

5. The method of claim 1, wherein the roofing membrane provided includes said hygroscopic dusting agent selected from the group consisting of silica gel, calcium chloride, zinc chloride, particulate cellulose, and absorbent clay particulate.

6. The method of claim 1, wherein the roofing membrane provided includes said hygroscopic dusting agent having a particulate size allowing it to pass through a number 220 mesh screen.

7. The method of claim 1, wherein the water-borne adhesive that is applied is synthetic latex.

8. The method of claim 1, wherein the water-borne adhesive that is applied has a solids content of greater than approximately 40 percent.

9. The method of claim 1, wherein the water-borne adhesive that is applied has a solids content of less than approximately 70 percent.

10. The method of claim 1, further comprising:

applying said hygroscopic dusting agent to all said at least one planar surface of the membrane;

applying said water-borne adhesive to all said at least one planar surface of the membrane or said non-porous roofing membrane; and pressing said at least one planar surface of the membrane to said non-porous roofing membrane so as to form a fully adhered roofing system.

11. A method of adhering a roofing membrane to a non-porous substrate on a non-porous roof surface or non-porous roofing material, the method comprising the steps of:

providing a roofing membrane having a hygroscopic dusting agent on at least one planar surface of the membrane;

applying a water-borne adhesive to at least one of the at least one planar surface of the membrane and a non-porous substrate;

mating the roofing membrane to the roof surface while the water-borne adhesive retains at least approximately 50 percent of its original water content; and applying pressure to the roofing membrane so that the hygroscopic dusting agent absorbs the remaining water content to allow the adhesive to cure even though the water is prohibited from evaporating or being absorbed by the roofing membrane or the non-porous substrate.

12. The method of claim 11, wherein the non-porous substrate is a non-porous roofing membrane.

13. The method of claim 11, wherein the step of applying a water-borne adhesive is performed using one of a roller, a sprayer and a power roller.

14. The method of claim 11, wherein the step of applying a water-borne adhesive includes applying the water-borne adhesive to both the at least one planar surface of the membrane and the non-porous substrate.

15. The method of claim 11, wherein the roofing membrane provided includes a hygroscopic dusting agent selected from the group consisting of silica gel, calcium chloride, zinc chloride, particulate cellulose, and absorbent clay particulate.

16. The method of claim 11, wherein the roofing membrane provided includes a hygroscopic dusting agent having a particulate size allowing it to pass through a number 220 mesh screen.

17. The method of claim 11, wherein the water-borne adhesive that is applied has a solids content of greater than approximately 40 percent.

18. The method of claim 11, wherein the water-borne adhesive that is applied has a solids content of less than approximately 70 percent.

19. The method of claim 11, further comprising:

applying said hygroscopic dusting agent to all said at least one planar surface of the membrane;

applying said water-borne adhesive to all said at least one planar surface of the membrane or said non-porous substrate; and pressing said at least one planar surface of the membrane to said non-porous substrate so as to form a fully adhered roofing system.

20. A method of providing a roofing contractor with a system for fully adhering a roofing membrane to a non-porous substrate on a roofing surface, the method comprising: providing a roofing membrane including a hygroscopic dusting agent on at least one planar surface of the roofing membrane in combination with a water-borne adhesive for fully-adhering the roofing membrane to the roof surface, where at least a portion of the roof surface includes a non-porous substrate to which the membrane can be secured via the water-borne adhesive and where the hygroscopic dusting agent absorbs the unevaporated water content to allow the adhesive to cure even though the unevaporated water is prohibited from evaporating or being absorbed by either the membrane or the non-porous substrate.

21. The method of claim 20, further comprising:

applying said hygroscopic dusting agent to all said at least one planar surface of the membrane;

applying said water-borne adhesive to all said at least one planar surface of the membrane or said non-porous substrate; and pressing said at least one planar surface of the membrane to said non-porous substrate so as to form a fully adhered roofing system.

* * * * *